US005321897A

United States Patent [19]

Holst et al.

[11] Patent Number: 5,321,897

[45] Date of Patent: Jun. 21, 1994

[54] FABRIC DRYER WITH ARCING AVOIDANCE SYSTEM

[75] Inventors: Melvin Holst, Gresham; Paul S. Payne, Portland, both of Oreg.

[73] Assignee: Mel Holst, Gresham, Oreg.

[21] Appl. No.: 875,258

[22] Filed: Apr. 27, 1992

[51] Int. Cl.[5] ..... F26B 3/34

[52] U.S. Cl. ..... 34/260; 219/690

[58] Field of Search ..... 34/1 Q, 48, 1 P, 1 DD; 219/19.55 A, 10.55 M, 10.55 R

[56] References Cited

U.S. PATENT DOCUMENTS 3,854,219 12/1974 Staats .
3,959,892 6/1976 Cloud et al. .
4,057,907 11/1977 Rapino et al. .
4,095,349 6/1978 Parker .
4,250,628 2/1981 Smith et al. .
4,267,643 5/1981 Haried ..... 34/48
4,313,044 1/1982 Staats .
4,334,136 6/1982 Mahan et al. .
4,356,640 11/1982 Jansson .
4,490,923 1/1985 Thomas .
4,510,361 4/1985 Mahan .
4,510,697 4/1985 Beasley et al. .
4,523,387 6/1985 Mahan .
4,703,565 11/1987 Kantor .
4,742,201 5/1988 Nakano et al. .
4,765,066 8/1988 Yoon .
4,771,156 9/1988 Strattan et al. .
4,795,871 1/1989 Strattan et al. .
4,829,679 5/1989 O'Connor et al. .
4,861,955 8/1989 Shen .
4,896,010 1/1990 O'Connor et al. .

*Primary Examiner*—Henry A. Bennet
*Attorney, Agent, or Firm*—Chernoff, Vilhauer, McClung & Stenzel

[57] ABSTRACT

A fabric dryer employs microwave energy and an auxiliary air convection heater to heat the moisture in the fabric to be dried and provides for control of the microwave energy so that no arcing of metal or other electrically conductive parts occurs as the fabric becomes dryer. The fabric dryer has a controller that receives input from sensors and uses that input to progressively decrease the energy output from the magnetrons in such a manner to prevent arcing of all metal and other electrically conductive materials associated with the fabric, while also controlling the auxiliary air convection heater and an exhaust air recirculator to compensate for the decreased magnetron energy output.

19 Claims, 10 Drawing Sheets

L1
N
L2
POWER SUPPLY
115
164
160
162
116
118
+5V +24V 140
138
132
TO 144
135
260
260a
261
262
134
136
130
+24V +5V +24V
122
124
118
116
128
123
133
120
102
114
+24V
CONTROLLER 100
+5V
146
113
104
108
106
110
112
147
152
150
268
TO 152
158
18
155
156
154
142
278
157
238
144
292
TO 145
143
145
TO 147

FABRIC DRYER WITH ARCING AVOIDANCE SYSTEM

BACKGROUND OF THE INVENTION

This invention relates to the field of drying fabric in a rotating chamber by means of microwave energy and/or convection-heated air.

A common method of drying fabric is a clothes dryer wherein moisture-laden fabric is loaded into a chamber that is rotated while convection-heated air is drawn through the chamber. The heated air causes evaporation of the moisture which is then drawn off with the exhaust air and deposited into the atmosphere. Improvements on the convention-heated clothes dryer employ a microwave energy source which is directed at the moisture-laden fabric to heat and vaporize the moisture which is then drawn off with the exhaust air. These microwave systems are superior because they are quicker and more energy efficient. This is so because the microwave energy focuses upon the moisture held by the fabric, rather than the fabric itself, thereby accelerating the drying process and reducing shrinkage. The following U.S. patents disclose microwave fabric drying systems, some of which also have auxiliary convection heating systems U.S. Pat. Nos. 3,854,219, 4,057,907, 4,250,628, 4,490,923, 4,510,697, 4,523,387, 4,703,565, 4,829,679, and 4,896,010. Some of those dryers use a convection heating system in combination with the microwave energy source so that the microwave energy can be turned off as the clothes approach the dry condition. The convection heater then warms the air circulating through the fabric chamber to remove the last bit of moisture from the fabric. It is necessary to either incrementally throttle down or shut off the microwave energy source as the clothes approach the terminal end of the drying cycle. This is done to prevent arcing of any metal and/or electrical conductor associated with the fabric, such as zippers or golf pencils, because ,the arcing may burn holes in the fabric. Various sensors are used to detect the almost-dry condition of the fabric and communicate with a controller which shuts off the microwave source. Various patents disclose the use of sensors to monitor the humidity of the intake and/or exhaust air for the purpose of controlling the microwave energy when the clothes are nearly dry; vis: U.S. Pat. Nos. 4,334,136, 4,510,361, 4,771,156 and 4,795,871. In all of the above-described patents the sensor's output is used to control only the on/off condition of the microwave One patent discloses using the output of a humidity sensor to modulate the pulse width of a magnetron controller thereby decreasing the microwave power as the exhaust decreases. U.S. Pat. No. 4,356,640 (col. 4, line 64 to col. 5, line 10).

To prevent leakage of microwave radiation it is necessary to seal the microwave container. The majority of microwave fabric drying systems employ "choke" seals between stationary bodies such as the access door and the main enclosure. Exemplarily, choke designs are shown in U.S. Pat. Nos. 4,313,044, 4,742,201, and 4,861,955. One patent discloses a rotary choke seal that is employed between a rotating body and a stationary body, U.S. Pat. No. 4,765,066.

Other means to improve the energy efficiency of standard fabric drying systems include recirculation systems and heat exchangers. A recirculation system, whereby a portion of the exhaust air is recirculated into the fabric chamber, is disclosed in U.S. Pat. No. 3,959,892. A heat exchanger whereby heat is exchanged between the warm exhaust air and the cooler intake air, is disclosed in U.S. Pat. No. 4,095,349.

None of the above dryers employ a full function control system that establishes a schedule of dryer operations based upon the sensor readings of the air flowing through the dryer. Additionally, none of the above dryers integrate alternative energy saving means (such as heat exchangers or recirculation systems) into the drying system under the control of the control system.

By failing to sense the condition of the intake air and use that information to customize the schedule of dryer operation the prior art systems fail to select the optimum efficiency for drying clothes and fabric.

SUMMARY OF THE INVENTION

The present invention is directed to arcing avoidance features in a microwave fabric dryer. The present invention provides a means for eliminating the risk of arcing by sensing the temperature of the exhaust air after it leaves the fabric chamber and, when the exhaust air reaches a predetermined threshold temperature which indicates that the clothes are nearing the dry condition where arcing might conceivably occur, a controller begins pulsing the magnetrons so as to reduce the amount of microwave energy that is generated and transmitted to the clothes drying chamber. The controller then begins a timed sequence in which the ratio of the ON-time to the OFF-time of the microwave energy decreases, thereby decreasing the power output of the magnetrons. At the end of the timed pulsing sequence the magnetrons are turned off and locked off for the remainder of the drying cycle in order to prevent the magnetrons from coming back on should a decrease in the exhaust temperature occur.

Accordingly, it is a principal object of the present invention to provide a fabric drying system which uses microwave energy to heat the moisture in the fabric to be dried and which uses a computer controller to regulate the magnetrons in a timed, pulsing sequence in such a manner that the microwave energy commences decreasing as the fabric reaches a predetermined state of dryness.

It is a further object of the present invention to provide a means for keeping the magnetron filament heated throughout the pulsing sequence in order to minimize the filament heating transient time (which is that time required to heat the filament to its operating temperature—normally 0.5 to 1.5 seconds).

It is a further object of the present invention to provide a fabric drying system that uses microwave energy to heat the moisture in the fabric and which comprises a sensor which detects the drying capability of the intake air and uses a computer/central processing unit to control the magnetron power output in response to the drying capability of the intake air.

It is a further object of the present invention to provide a fabric drying system that uses microwave energy to heat the moisture in the fabric to be dried and which further includes a sensor that detects the condition of the exhaust air and further provides computer means that can control the power output of the magnetrons in response to the condition of the exhaust air.

It is a further object of the present invention to provide a fabric drying system that uses microwave energy and an auxiliary source of convection heated air to heat the moisture in the fabric to be dried and uses a computer means for controlling the convection heated air source in response to the time averaged energy output from the magnetrons.

It is a further object of the present invention to provide a fabric drying system that uses microwave energy and an auxiliary convection heated air source for heating the moisture in the fabric to be dried and which further provides a sensor that detects the condition of the air being exhausted from the fabric drying chamber, which condition is read by a computer means which then controls the source of microwave energy and/or the auxiliary convection heated air source in response to the condition of the exhaust air.

It is a further object of the present invention to provide a fabric drying system that uses a heat source for heating the moisture in the fabric to be dried and uses a computer means for controlling the time averaged energy output of the heat source and further has a recirculator for recirculating a portion of the air exhausted away from the fabric drying chamber which recirculator can be controlled by the computer in response to the time-averaged energy output from the heat source.

The foregoing and other objectives, features and advantages of the invention will be more readily understood upon consideration of the following detailed description of the invention, taken in conjunction with the accompanying drawings.

DETAILED DESCRIPTION OF THE PREFERRED EMBODIMENT

Figure 1:
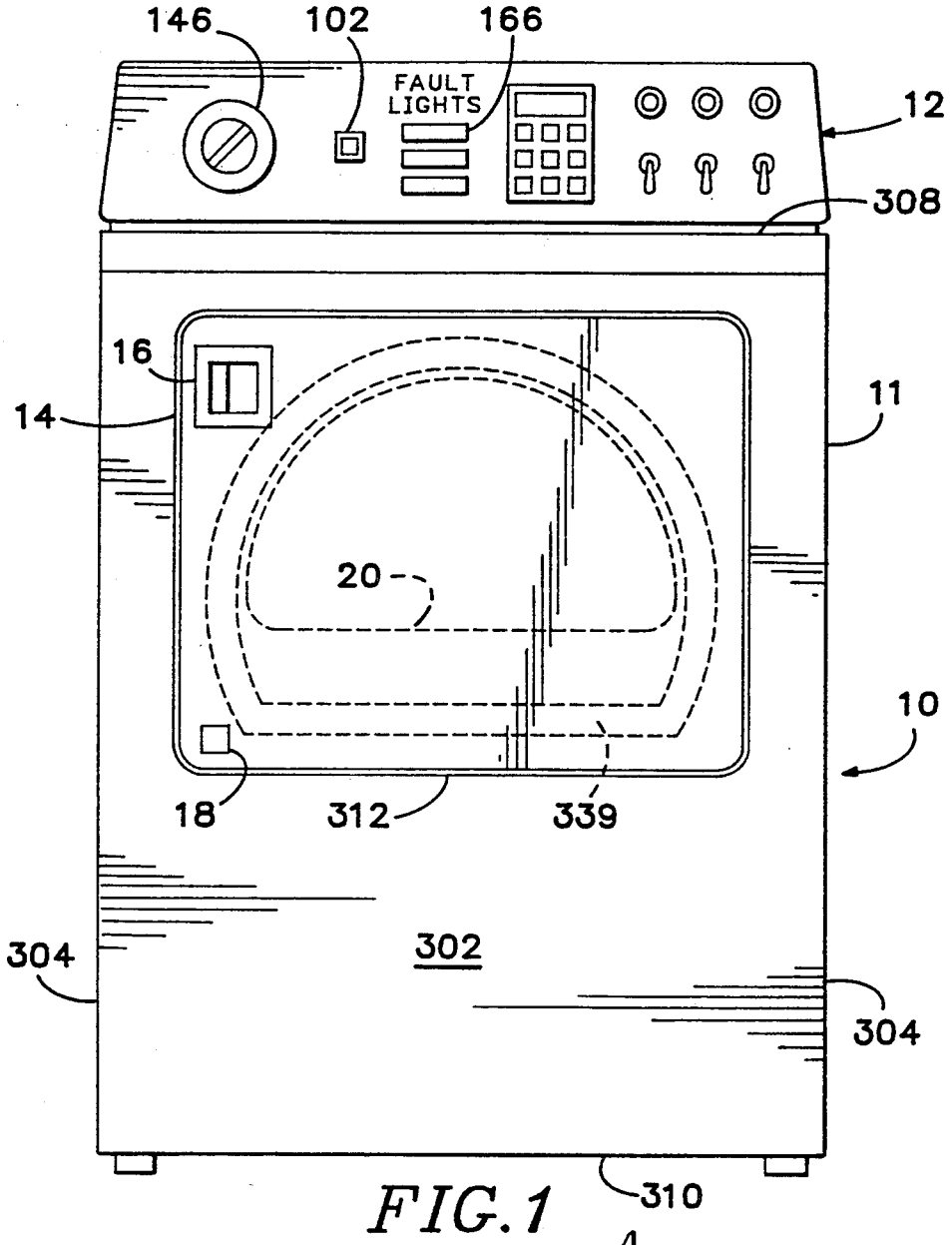
FIG. 1 is a front elevational view of a preferred embodiment of a fabric drying system of the present invention.

A preferred embodiment of the present invention provides a fabric drying system having various heat sources for heating the moisture in wet fabric to the point that the moisture vaporizes and then removing the vaporized moisture from the system and exhausting it to the atmosphere. A control system controls all parts and mechanisms of the system. FIG. 1 shows an exemplary embodiment of the present invention showing the fabric drying system 10 that includes an exterior housing 11, a control panel 12 and a chamber access door 14. The access door has a handle 16 that permits the access door to be opened exposing an opening 20 to an interior chamber of the fabric drying system. The access door is provided with an interlock 18 that prevents operation of the fabric drying system when the access door 14 is open.

Air Flow

Figure 9:
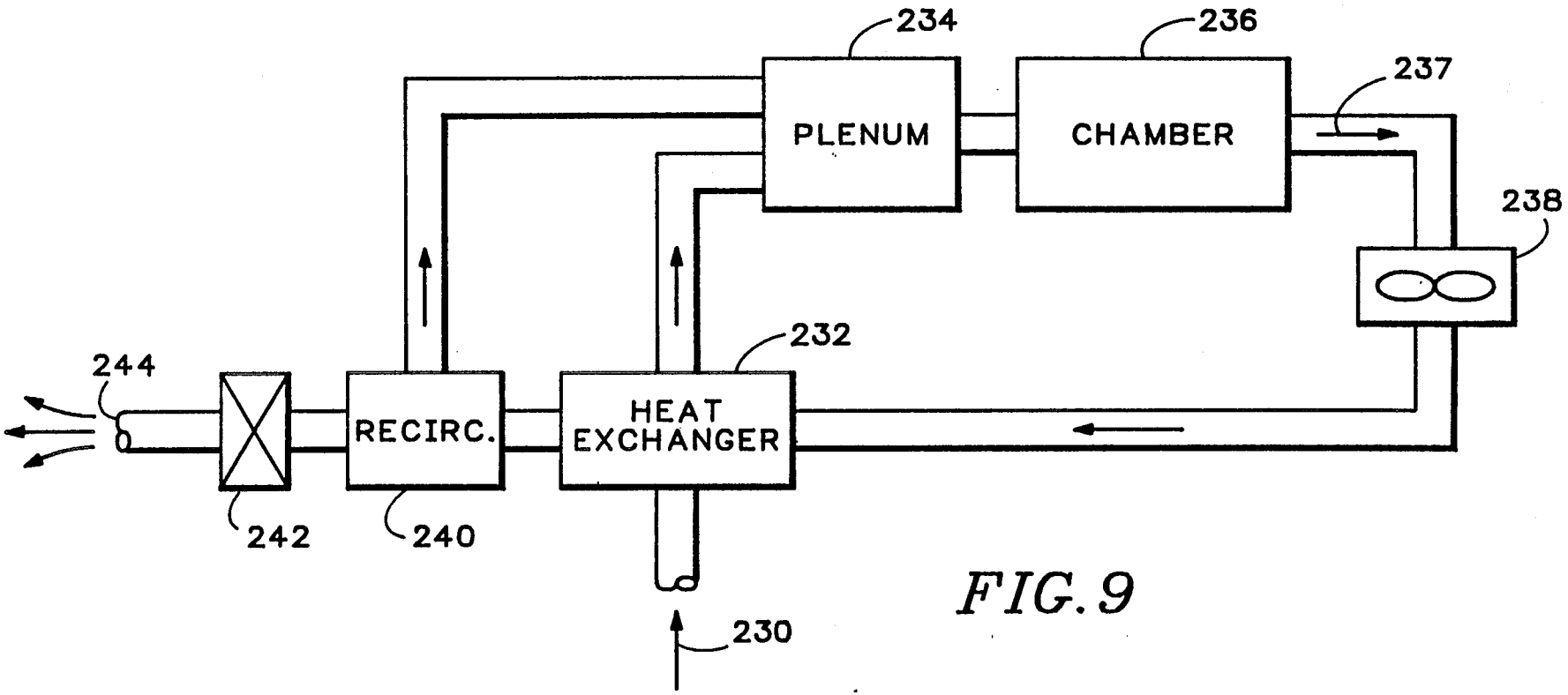
FIG. 9 is a block diagram showing the air flow and related major components of the fabric drying system.

The vaporized moisture is discharged to the atmosphere by an air flow system which is shown diagrammatically in FIG. 9. All air flow is powered by a fan 238. The inlet air 230 enters the system and passes through a heat exchanger 232 and then proceeds to a plenum 234. From the plenum the air enters a chamber 236 wherein moisture-laden fabric has been placed to be dried. In the chamber the air picks up any moisture that has been vaporized from the moisture-laden clothing and, as exhaust air 237, is then drawn off by the fan 238. After the fan, the exhaust air passes through the heat exchanger 232 where the warm exhaust air transfers some of its heat energy to the intake air 230 by conduction. After passing through the heat exchanger the air flows to a recirculation unit 240 where a portion of the exhaust air may be drawn off. The recirculated portion of the exhaust air flows into the plenum ,234 where it is mixed with the intake air before proceeding into the chamber 236. The recirculation unit 240 has a baffle which may be "opened" or "closed" by the control system depending upon various system parameters. When the recirculation baffle is closed none of the exhaust air is recirculated. Conversely, when the recirculation baffle is open a portion of the exhaust air is recirculated to the plenum and another portion of the exhaust air passes through the recirculation unit and through an exhaust air damper 242. The damper 242, when closed, will prevent all exhaust air from leaving the system and, when open, will allow all of the exhaust air to leave the system and exit at 244.

Figure 8:
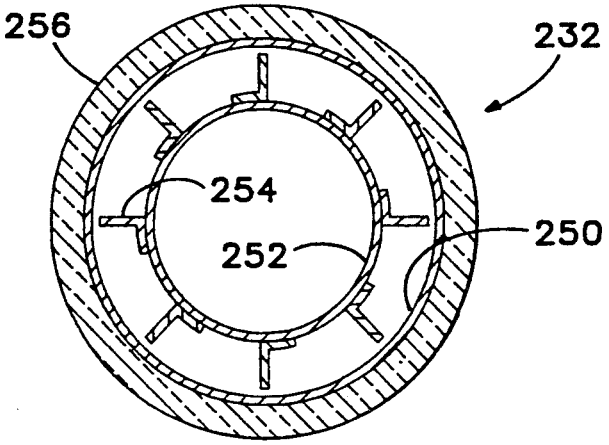
FIG. 8 is a cross-sectional view of coaxial ducting of a heat exchanger used in the fabric drying system of FIG. 1.

The air flow system and its associated components will now be described in detail with reference to FIGS. 4–8. Starting with FIG. 7, the intake air 230 is shown entering the exterior housing 11 through a housing access opening 246. The intake air enters the heat exchanger 232 at the heat exchanger opening 248. A cross section of the heat exchanger is shown in FIG. 8 which reveals that the heat exchanger is comprised of coaxially positioned ducts which are the intake air duct 250 and exhaust air duct 252, respectively. The exhaust air duct is made of a thermally conductive material so that heat from the warmer exhaust air is transferred to the cooler intake air. To increase the surface area of the thermally conductive surface the exhaust air duct has a plurality of externally mounted fins 254. The heat exchanger is enclosed in a thermally insulated material 256.

At the downstream end of the heat exchanger 258 the intake air enters the lower plenum 234. The lower plenum is an open volume that houses magnetrons 260, each having an associated cooling fan 262 and a panel 264 that contains the system's electronics 64. Additionally, the lower plenum houses the exhaust air recirculation shunt 266 and its associated baffle assembly 296 operated by solenoid 268 which comprise the recirculation unit 240. When the magnetrons are operating they generate substantial heat energy which is drawn off by the cooling fans and imparted to the intake air that is passing through the plenum. Thus, intake air that has been preheated once by the heat exchanger 232 is heated a second time by the heat of operation associated with the magnetrons 260. After passing through the lower plenum, the intake air is drawn upward into the upper plenum 274.

Figure 6:
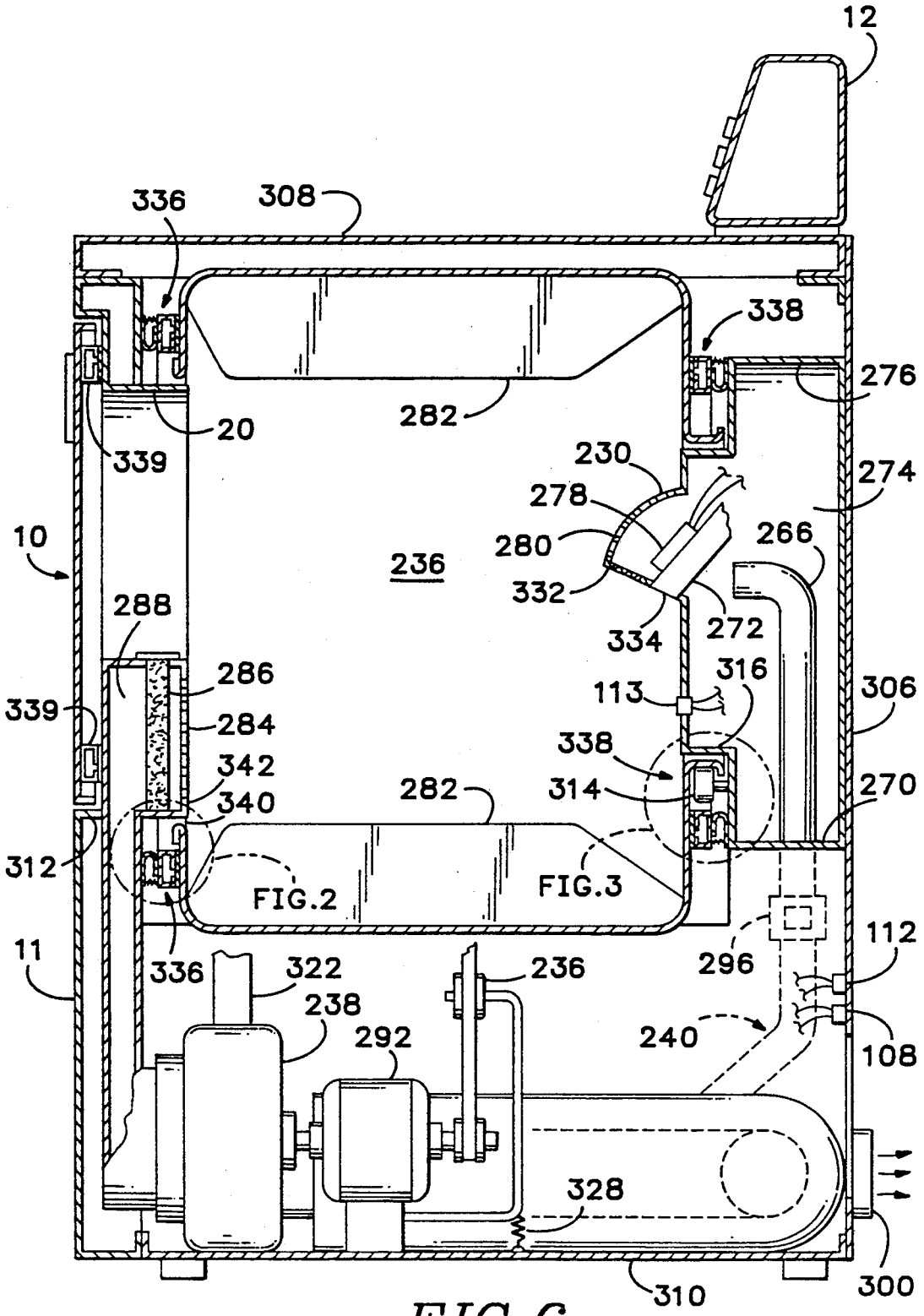
FIG. 6 is a side cross-sectional view taken along line 6—6 in FIG. 4.
Figure 7:
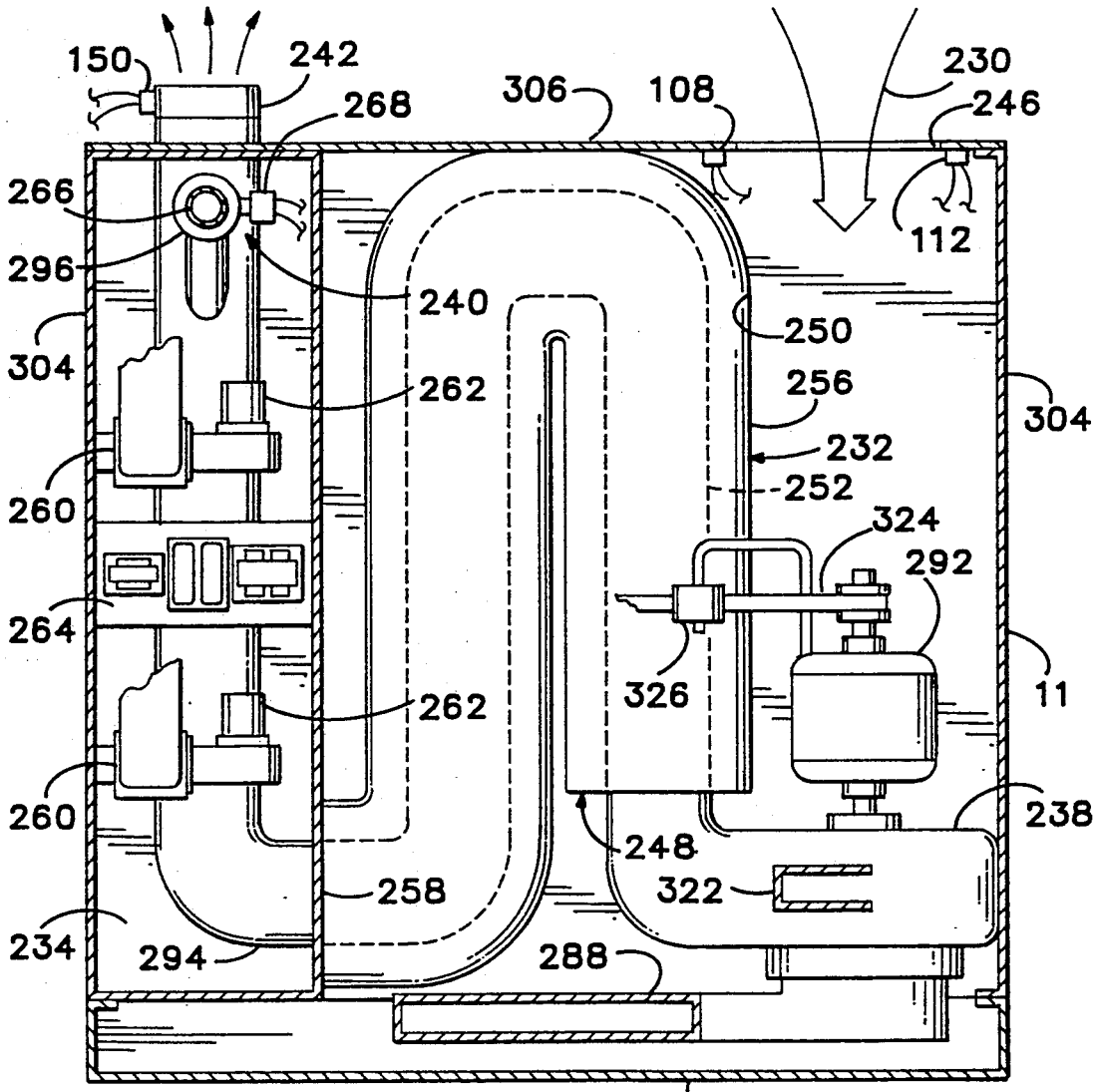
FIG. 7 is a top view of a cross section taken along line 7—7 in FIG. 4.

FIG. 6 shows a side cross-sectional side view where the upper plenum 274 is shown at the rear of chamber 236. The upper plenum 274 is defined by lower surface 270 and upper surface 276. Contained within the upper plenum are the exhaust air recirculation shunt 266, the microwave waveguides 272, and the augmentation heater coil 278. Intake air is mixed with recirculated exhaust air and then heated by the augmentation heater 278 after which it enters chamber 236 through the perforated dome segment 280. Chamber 236 will contain the moisture-laden fabric that is to be dried. As will be explained in more detail below, the microwave energy and the now hot intake air vaporize the moisture from the fabric so as to dry it.

Chamber 236 rotates about a horizontal axis so that the fabric to be dried is tumbled by the rotary action. Tumbling of the fabric is further enhanced by paddles 282 that are attached to the chamber in a conventional way that is well known in the clothes drying art.

The moisture-rich chamber air is exhausted through the perforated surface 284 and through the lint filter 286 into a primary exhaust duct 288. This exhaust air has the characteristics of being warm and having a high moisture content. After the exhaust air passes through the lint filter 286 and travels along the primary exhaust duct 288 it encounters the fan 238 which is driven by motor 292 in a direct drive fashion. After leaving the fan 238 the exhaust air enters the heat exchanger 232 where heat is conducted from the higher temperature exhaust air to the lower temperature intake air as it travels the length of the coaxial ducting. At the terminus 258 of the heat exchanger the exhaust air enters a secondary exhaust duct 294 which runs through the lower plenum 234. Near the end of the secondary exhaust duct is the recirculation unit 240 which is comprised of the exhaust air recirculation shunt 266 and the baffle assembly 296. Exhaust air flow through the shunt is controlled by the recirculation baffle assembly 296 which is controlled by the baffle assembly solenoid 268. Accordingly, when the baffle 296 is "open" a portion of the exhaust air traveling along the secondary exhaust duct is recirculated into the upper plenum 274 where it is mixed with intake air before entering the chamber 236.

Downstream of the recirculation unit 240 is an exhaust damper 242. The exhaust damper is controlled by a damper control 150 that opens and closes the damper. When closed, the damper prevents the exhaust air from exiting the dryer system. In normal operation, the exhaust damper will be closed only during the start-up phase of a drying cycle when the recirculation baffle is open. This accelerates the warm-up phase of the drying cycle by recirculating a portion of the preheated exhaust air back into the chamber 236. When the exhaust damper is open, exhaust air can freely exit the secondary exhaust duct at its end 300.

An exhaust air thermistor 110 is located in the secondary exhaust duct near its end 300 in order to sense the temperature of the exhaust air. Data from this sensor is used to trigger successive stages of the drying cycle as will be explained.

Mechanical Structure

Figure 4:
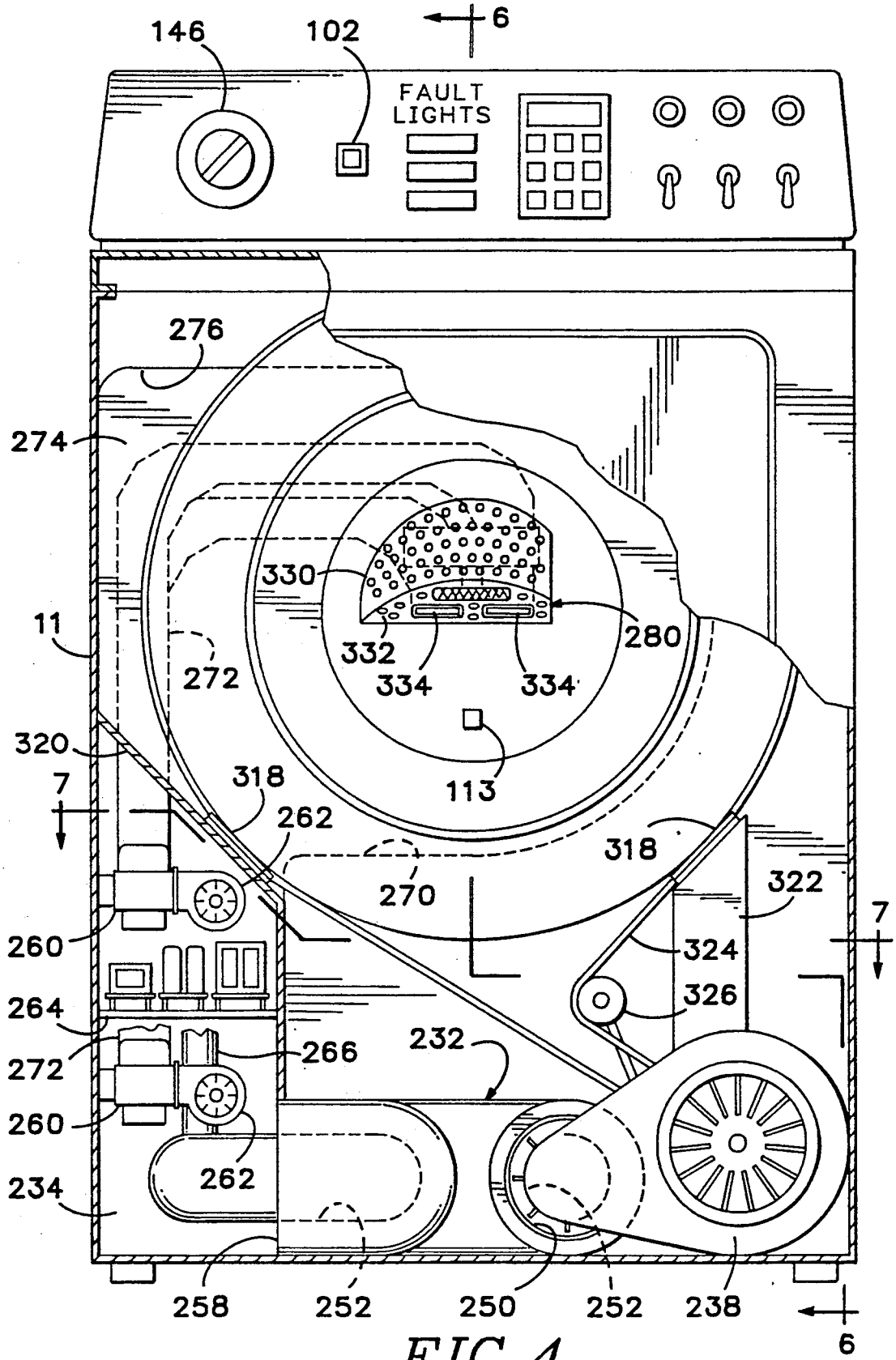
FIG. 4 is a front elevational view of the fabric drying system of FIG. 1 showing part of the exterior housing cut away to reveal the inner components.

With regard to FIGS. 1 and 6 it may be seen that the exterior housing 11 consists of six panels: a front panel 302, two side panels 304, a rear panel 306, a top panel 308, and a bottom panel 310. The front panel 302 defines an access door opening 312 which interacts with the access opening door 14 such that the door may be hingedly mounted to the front panel 302 and closed to make the door flush with the surface of the front panel. Opening the door reveals the access opening 20 which provides access to the chamber 236 which receives the moisture-laden fabric that is to be dried. Chamber 236 is rotatably mounted within the exterior housing 11 such that it may rotate about a horizontal axis thereby tumbling the fabric. The back of the chamber is supported by a pair of rollers 314 (only one roller is visible in FIG. 6) that are rotatably mounted to an exterior surface of an upper plenum wall 316. The front of chamber 236 is supported by a pair of forwardly mounted shoes 318 (FIG. 4). One shoe is mounted to the inclined exterior surface of the lower plenum wall 320 and the second shoe is mounted to a stand off 322 which is mounted to fan 238. The shoes rub directly against the exterior surface of the drum 236, and consist of a low friction, high wear-resistant material such as mylar or nylon. Rotation of the chamber 236 is accomplished by means of a belt drive 324 which is driven by motor 292. Belt tension is maintained by an idler roller 326 and tensioning spring 328.

The magnetrons 260 are located within the lower plenum 234. Microwave energy is conducted from the magnetron antennas in the microwave waveguides 272 which extend upward and to the rear into the upper plenum 274 where they terminate at a perforated dome segment 280 which is fixedly attached to the upper plenum wall 316. The dome segment has two portions: a curved portion 330 and a flat surface 332. The flat surface 332 has two windows of microwave transparent material 334 which are in communication with the open ends of the microwave waveguides 272. The flat portion 332 is inclined so that the waveguide ends are oriented in a manner that directs the microwave energy downward towards, the bottom of chamber 236. This orientation is optimum because it has been found that the fabric being dried tends to cluster at the bottom of the chamber even while the chamber is rotating and paddles 282 are agitating the clothing.

The dome segment 280, although perforated, is impervious to microwaves so that microwaves in chamber 236 may not travel back through the dome into the upper plenum. The curved portion 330 is cut away on one side to prevent jamming fabric between the dome and the paddles 282.

Rotary Choke Seals

For safety reasons, it is important that the microwave energy be contained within the fabric drying system. Further, it is important to isolate the microwave energy away from the system components such as the electronics panel 264 and the motor 292 to prevent their damage. This requirement means that the microwave energy must not escape past the opening between the rotating chamber 236 and the stationary bodies of the upper plenum 274 and housing 11. The microwaves are contained by unique rotary choke seals 336 and 338 which are shown in detail in FIGS. 2 and 3, and by a conventional access door seal 339 shown in FIGS. 1 and 6.

Figure 2:
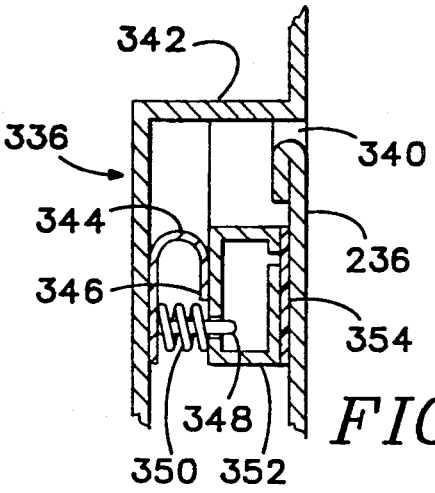
FIG. 2 is a cross-section of a rotary choke seal.

FIG. 2 shows a cross-section of the forward rotary choke seal 336 which prevents the escape of microwave energy from between the front of the rotating chamber 236 and the stationary member 342. The choke seal consists of a microwave impervious screen material 344 that is annularly shaped and has an inside rolled edge 346. The non-rolled edge is attached to the stationary wall 342. Protruding from the stationary wall is a post 348 and biasing spring 350. The post projects into a choke box 352 and aligns the biasing spring 350 such that it urges against the choke box thereby yieldably urging the choke box in the direction of the chamber 236. A mylar pad 354 is located between the choke box and the chamber as a low-friction and high wear-resistance interface. The inside rolled edge 346 of the microwave impervious screen 344 is connected to the choke box 352. In this manner, microwaves which escape through the gap 340 are reflected by the screen 344 and attenuated by the choke box 352.

Figure 3:
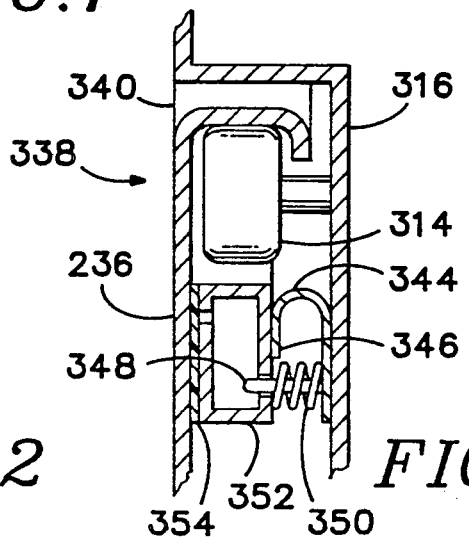
FIG. 3 is a cross section of the rotary choke seal at the location of a support roller.

FIG. 3 shows the rearward rotary choke seal 338 which has a configuration substantially identical to the forward rotary choke seal 336. The significant differences are in the presence of a roller 314 mounted to the upper plenum wall 316 in order to rotatably support the rearward portion of the chamber 236. Aside from these differences the rearward rotary choke seal performs in an identical manner to the forward rotary choke seal.

Sources of Heat Energy

The fabric drying system employs magnetrons 260 for generating microwave energy which is directed at the moisture-laden fabric in the chamber in order to heat the moisture to the point of vaporization and thereby dry the fabric. The microwave energy is conducted from the magnetrons to the fabric chamber by waveguides 272. The wave guides are configured so that none of the bends exceed 30° so that the microwave energy is not attenuated as would occur with sharper angles. Optimally, the system will use four 700 watt magnetrons operating at a frequency of 2450 MHz, although a lesser number of higher power magnetrons could be used depending on cost considerations. The magnetrons have conventional filaments 260*a* which are heated by inductance heaters 261 to maintain them at an operating temperature between pulses of the magnetrons, as explained hereafter.

Another heat source for warming the moisture in the fabric is the augmentation heater 278 which is an electrically powered convection heater that heats the intake air just prior to the air's entry into the fabric chamber. The augmentation heater is located in the upper plenum 274 on an interior surface of the upper plenum wall 316 just behind the perforated dome 280. The augmentation heater is used primarily in the initial stages of the drying process to quickly bring the chamber air and moisture-laden fabric up to a predetermined warm temperature. After achieving the predetermined temperature the augmentation heater is shut down for most of the remaining stages until the end of the cycle where the augmentation heater is turned on to provide the final drying.

Another source of heat energy is the heat exchanger 232, the physical configuration of which has already been described. The heat exchanger provides "free" added heat to the system by conducting heat from the relatively hot exhaust air and then from the even hotter magnetrons to the relatively cooler intake air. As shown in the preferred embodiment, the intake air and exhaust air flow along the heat exchanger in the same direction. Alternately, however, the heat exchanger could be arranged such that the exhaust air flows in the opposite direction. It is important, however, that the intake air receive heat first from the exhaust air and then from the magnetrons so that maximum temperature differentials optimize the heat transferred in each instance.

Another source of heat energy is the recirculation system 240 wherein a portion of the exhaust air is shunted from the secondary exhaust air duct 294 and returned to the upper plenum 274 where it is mixed with intake air before proceeding into the fabric chamber. This recirculation system provides heat to the system by combining the warmer exhaust air with the relatively cooler intake air in the upper plenum thereby inexpensively raising the overall temperature of air going into the chamber.

Controller and Electronics

A controller 100 processes information received from various transducers and, based upon that information, creates a schedule of operation for the fabric drying system and then operates the various heat sources and system components in accordance with that schedule.

Figure 10:
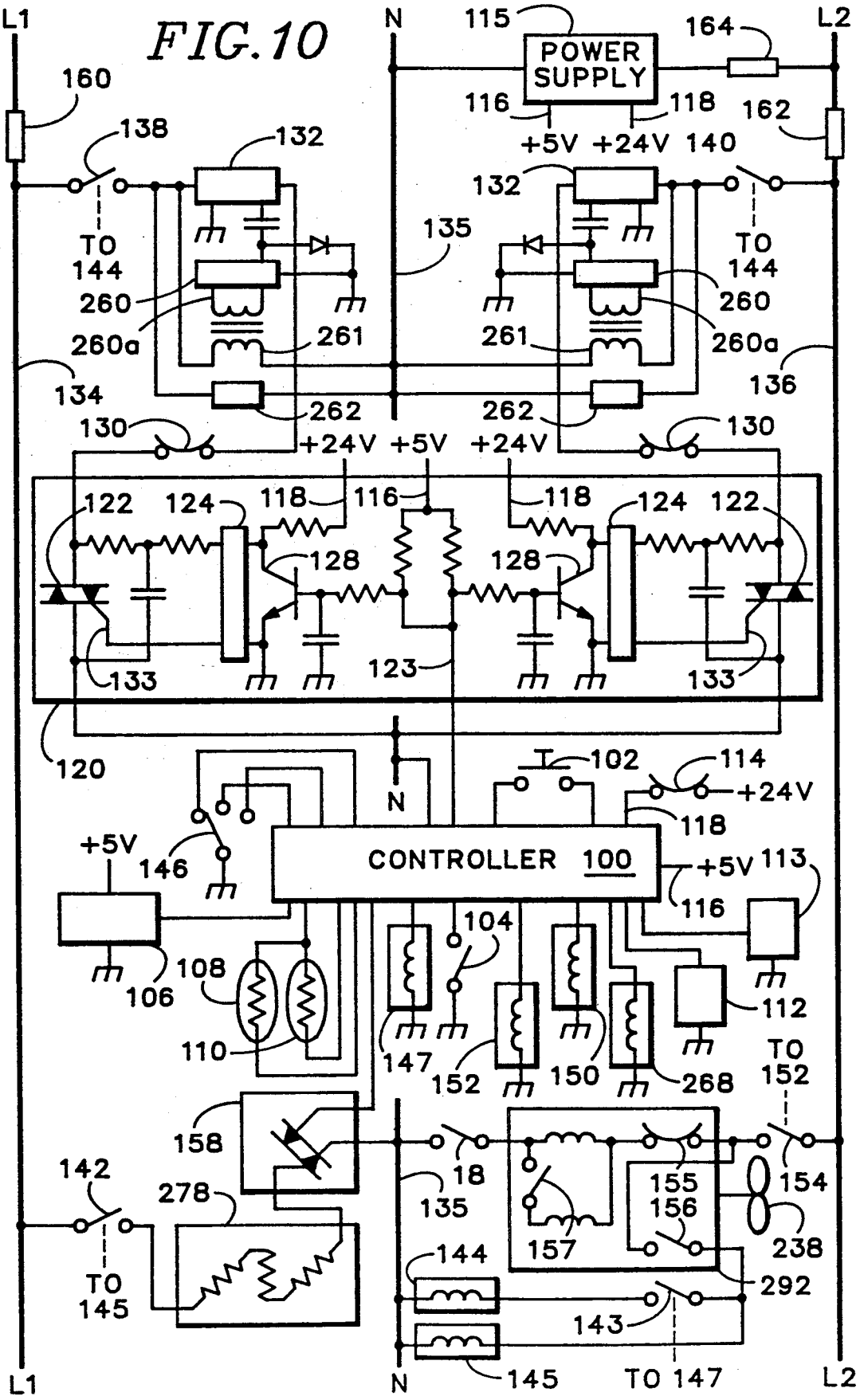
FIG. 10 is a block diagram of the controller and circuitry of the fabric drying system.
Figure 11A:
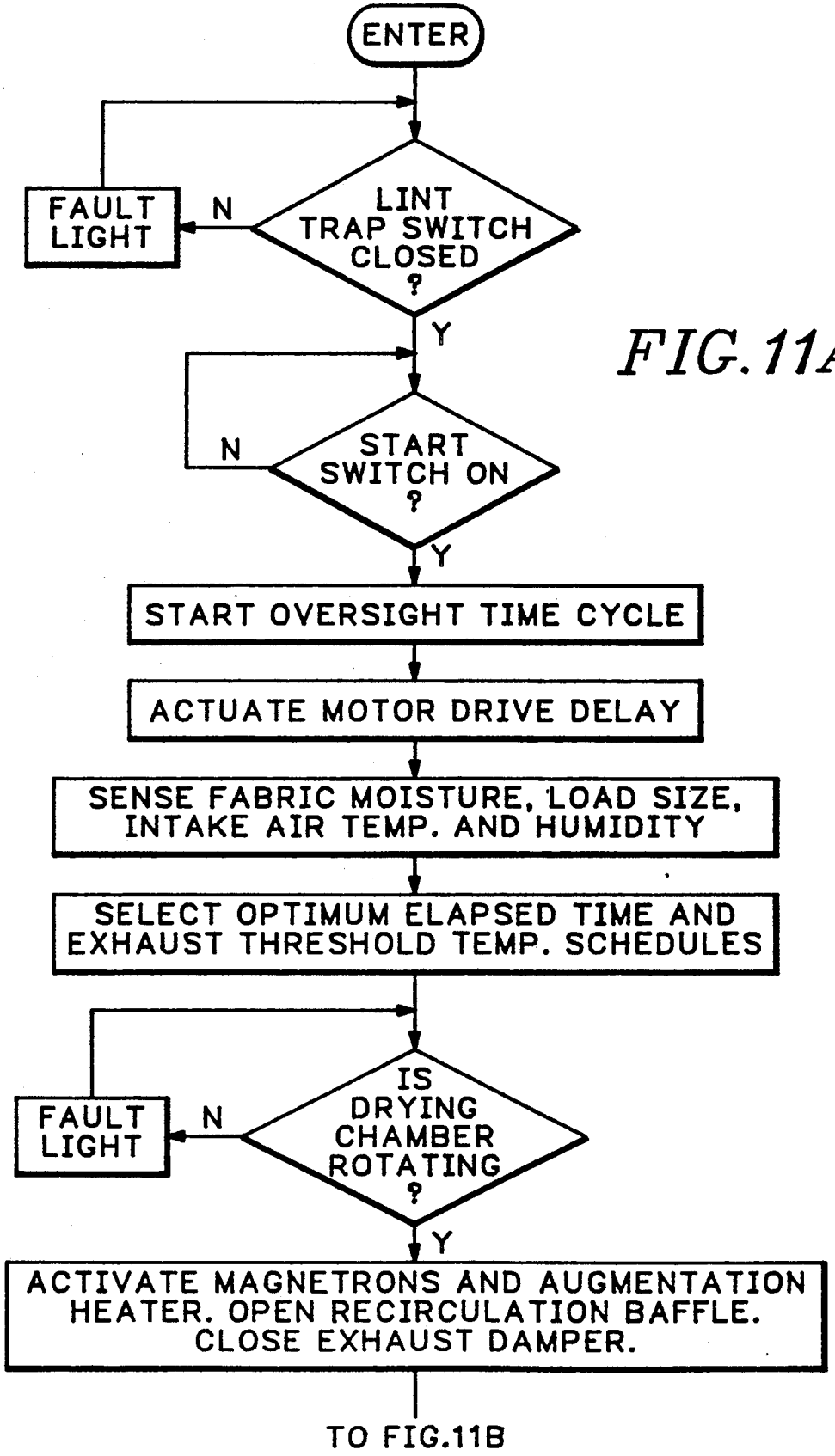
FIG. 11 is a simplified logic flow diagram showing exemplary programming of the controller.
Figure 11B:
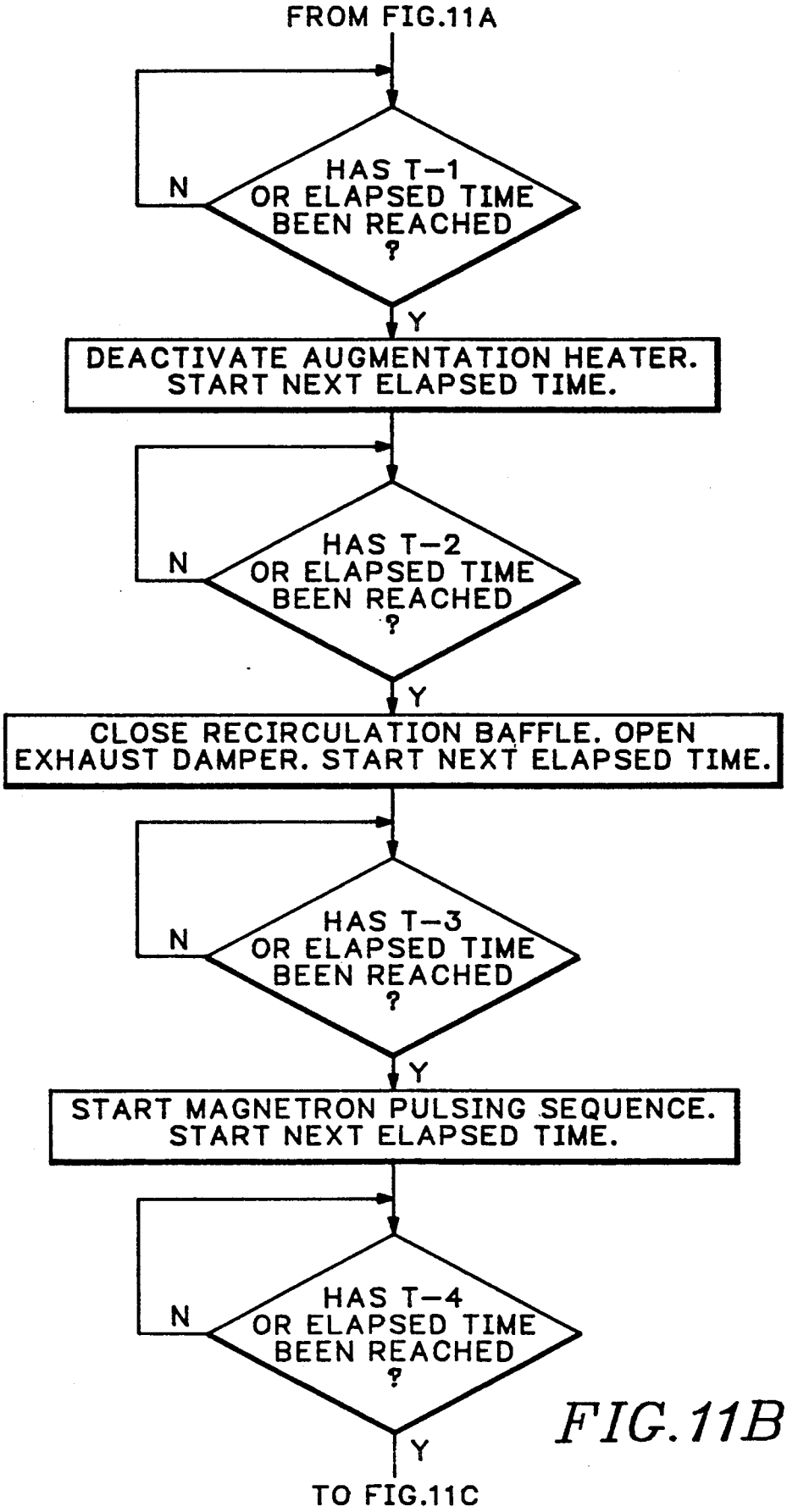
Figure 11C:
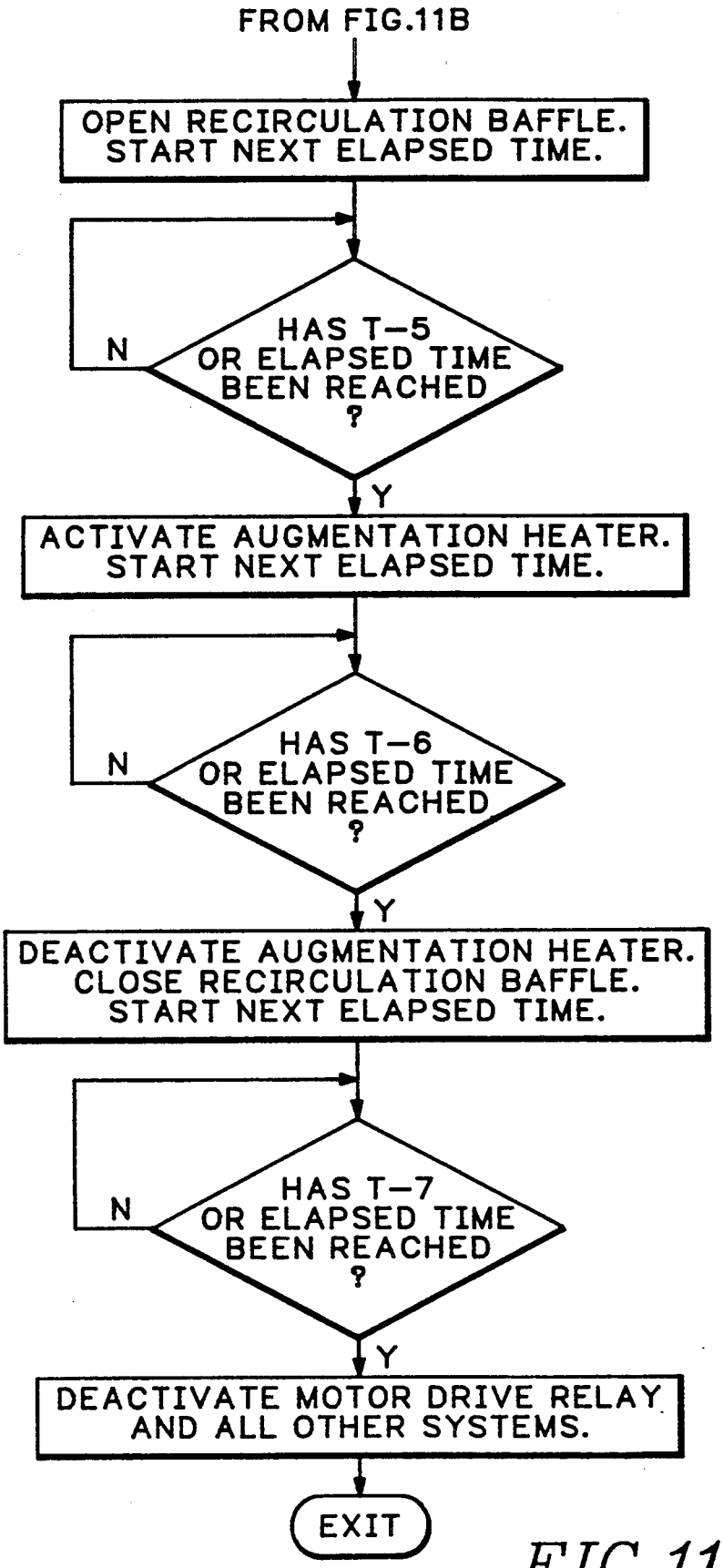

With reference to FIG. 10, the controller 100 is a conventional microprocessor-based central processing unit (CPU) programmed in accordance with the logic flow diagram of FIG. 11. The controller receives a number of input signals: a start switch 102; a lint trap switch 104; a rotation sensor 106; two thermistors, one for the intake air 108 and one for the exhaust air 110; a humidity sensor 112; a moisture sensor 113; and a load size option switch 146 which permits the user to indicate the size of the fabric load, e.g. small, medium or large. The start switch 102 is used to start the entire drying cycle. The lint trap switch 104 is an interrupt switch which prevents initiation of the drying cycle if the lint trap has not been cleaned and properly replaced. The rotation sensor 106 detects rotation of the fabric chamber 236 and is a precondition to operation of the magnetrons thereby preventing the powering of the magnetrons when the chamber is not rotating. The intake thermistor 108, exhaust thermistor 110 and humidity sensor 112 serve to communicate air temperature and humidity information to the controller CPU 100 in order to select an optimum schedule for the drying cycle. The moisture sensor 113 detects the amount of moisture in the fabric in the fabric chamber prior to initiation of the drying cycle. In the preferred embodiment the moisture sensor 113 is in contact with the wet clothing and measures the conductivity across a pair of contacts. Power for the controller is provided on input lines 116 and 118 which provide plus five volts DC and plus 24 volts DC, respectively. An exhaust air thermal switch 114 acts as a safety switch to shut down the system if the exhaust air reaches a predetermined temperature which indicates an unsafe condition.

The controller controls the drive circuit 120 which controls the power to the magnetrons. The preferred embodiment of this fabric drying system uses four 700 watt magnetrons to provide a total of 2800 watts of microwave energy for drying the fabric. FIG. 10 and the description only show two magnetrons for simplicity; however, it is understood that those familiar with the art could easily modify this circuit to include the two additional magnetrons. The drive circuit 120 contains TRIACS 122 which have three lines: one to a transformer 132 that energizes one magnetron, one to ground/neutral and the third serving as a control line 133. An optoisolator 124 and transistor 128 are interposed between the control line 133 and a control line 123 from the controller 100. When the controller sends a control signal to a TRIAC via control line 123, the TRIAC closes the circuit between the transformer and ground/neutral. Thus, when a relay switch 138 (or 140) has been closed, the transformer is receiving electrical energy because it is connected to a high voltage power line 134 (or 136) and to ground/neutral (line 135) via the TRIAC. When the transformer 132 is receiving electrical energy it is actuating the magnetron 260 which then produces microwave energy.

Relay switches 138 and 140 are controlled by a main power relay 144 which is energized upon system start-up. In series with relay 144 is a normally closed magnetron lock-out switch 143 which is controlled by a lock-out relay coil 147. As explained in the operation section below, at a particular stage in the drying cycle the controller will issue a lock-out command by activating lock-out coil 147 which will open the lock-out switch 143 deactivating coil 144 and opening relay switches 138 and 140 thereby taking the magnetron transformers 32 offline until a new cycle is started.

When relays 138 and 140 are closed, the magnetron fans 262 are energized independently of the TRIACS. Thus, the fans run the entire time from the beginning of the drying cycle until the magnetrons are completely deactivated and "locked off." Magnetron tube thermal switches 130 interrupt power to the transformers 132 in case of excessive heat.

Figure 5:
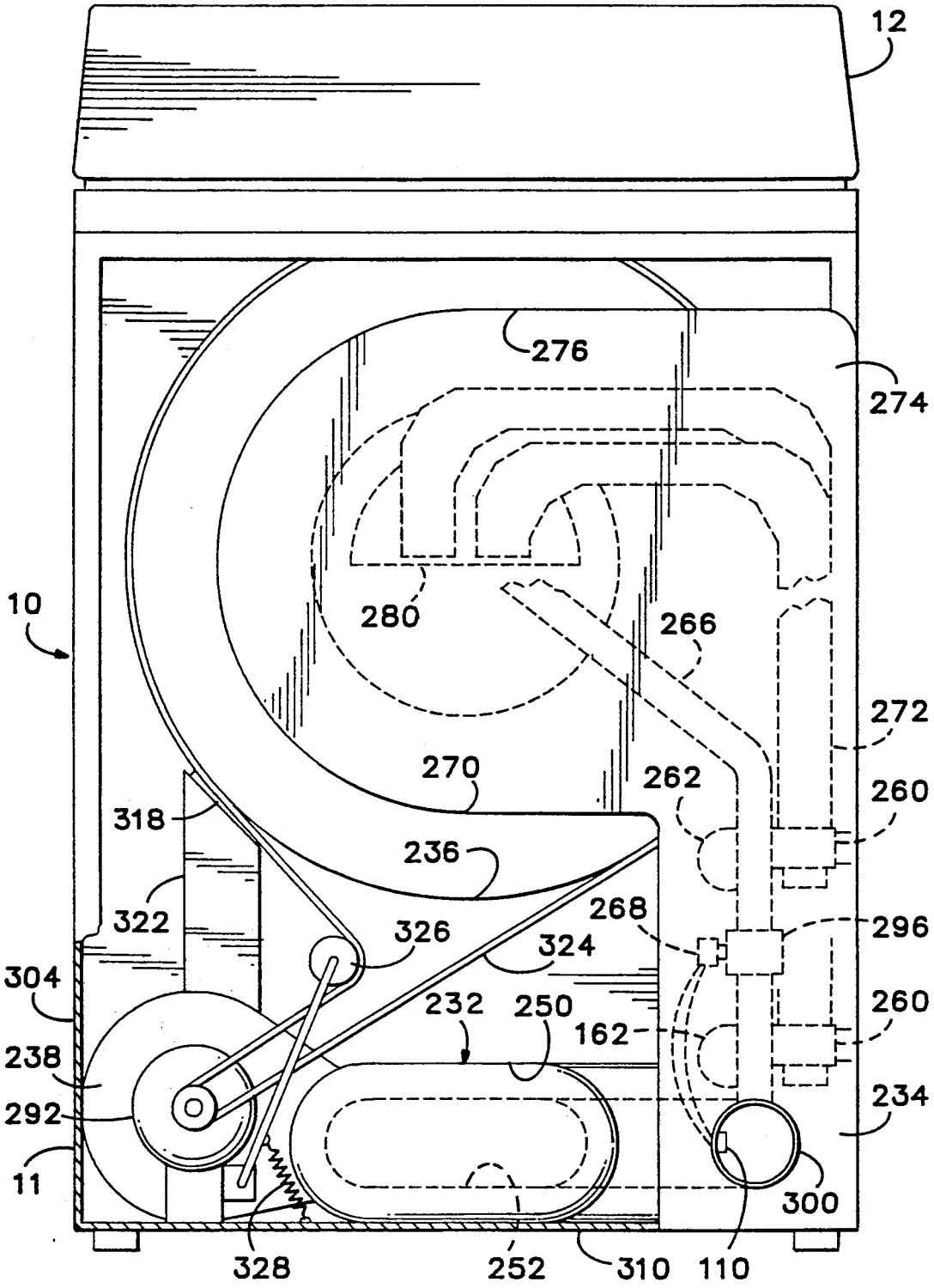
FIG. 5 is a rear elevational view of the fabric drying system of FIG. 1 with the rear cover of the exterior housing removed.

The controller controls the recirculation baffle assembly 296 which opens and closes the recirculation shunt 266 via the damper solenoid 268 (FIG. 5). The controller also controls the exhaust damper solenoid 150 which opens and closes the exhaust damper 242. In the preferred embodiment the recirculation baffle and exhaust damper are controlled by solenoids, which simply open or close those dampers. Alternatively, the recirculation baffle and exhaust damper may be controlled by motors, via motor controllers, that permit the baffle and damper to be incrementally controlled from fully open to fully closed.

The controller also controls relay coil 152 which in turn opens and closes relay switch 154 which is located between power line 136 and the motor 292. The motor 292 is connected to the ground line 135 via access door interlock 18 which prevents motor operation when the door 14 is open. The motor is further protected by an overload protector 155. In addition, the motor is further protected by a centrifugal switch 156. The motor is mechanically connected to the fan 238.

The controller 100 also controls the augmentation heater 278. Upon system start-up a heater power relay 145 is energized which closes relay switch 142 connecting the heater 278 to power line Ll. Thereafter, the controller turns the heater on and off by means of a control signal to TRIAC 158.

The power lines 134 and 136 have current limiting fuses 160 and 162, respectively and a DC power supply 115 is connected to the high power line 136 through current limiting fuse 164.

Operation of the Fabric Dryer

This section discusses the operation of the fabric dryer. The fabric drying system may be located in a commercial setting such as a laundromat or in a residential home. System operation is the same in both cases. The person using the fabric drying system will be referred to as the operator.

The entire fabric drying operation is referred to as a cycle which is composed of numerous stages regulated by the controller 100 in accordance with the logic flow diagram of FIG. 11. Each stage is characterized by the configuration of the active elements of the system. The four active elements are the magnetrons 260, the augmentation heater 278, the recirculation unit 240, and the exhaust damper 242. All active elements are controlled by the controller 100. A particular stage, for example, may have the magnetrons on, the augmentation heater off, the recirculation baffle open and the exhaust damper open.

The sequential order of stages is the same for each fabric drying cycle. However, the initiation time and duration of each stage is preferably variable depending on a schedule of elapsed times predetermined by certain parameters which include the moisture of the fabric, the intake air temperature and/or humidity and the load size, and also depending on the exhaust air temperature as compared to a schedule of exhaust threshold temperatures predetermined by the same parameters. Essentially, the controller will have a table of sets of elapsed times and sets of exhaust threshold temperatures. Each set is a schedule. The controller will select the respective optimum elapsed time schedule and optimum threshold temperature schedules for a particular load based on the moisture of the fabric as determined by the moisture sensor 113, the indicated load size, and the intake air temperature and/or humidity as determined by sensors 108 and/or 112 which indicate the drying capability of the intake air. The exhaust temperature as determined by thermistor 110 is then compared against the schedule of threshold temperatures as drying progresses to trigger the end of each stage unless the stage has been terminated earlier by the schedule of elapsed times.

Initially, the operator loads fabric or clothing into the dryer chamber 236. Next, the operator cleans and replaces the lint filter 286 which closes the lint trap switch 104 which is a necessary condition to initiate the cycle. Next, the operator closes the access door 14 thereby closing switch 18 which closes the circuit to the motor 292. The operator then indicates the load size from the option switch 146. The operator then pushes the start button 102 which initiates the fabric drying cycle.

Upon initiation of the cycle the following events occur automatically:

(1) An oversight time cycle dependent upon the indicated load size is initiated by means of a timer circuit within the controller 100 which assures that the machine will not run beyond a preset time in the event of any malfunction.

(2) The motor relay coil 152 is energized by the controller 100 causing contacts at relay switch 154 to close and complete the circuit to the motor windings.

(3) The motor 292 begins to rotate causing centrifugal switch 156 to close and the start winding switch 157 to open. The opening of the start winding switch breaks the circuit to the motor's start winding and permits the motor to assume its normal operating condition.

(4) The motor mechanically transfers power to the fan 238 and the belt drive 324 causing the fan to move air and the chamber 236 to rotate.

(5) As the motor operates under normal operating condition, the main power relay coil 144 is energized and closes relay switches 138 and 140, and the heater power relay coil 145 is energized closing relay switch 142. The closing of relay switches 138 and 140 connects the transformers 132 to power lines 134 and 136, Closing relay switch 142 connects the augmentation heater 278 to the power line 134.

The system then begins an approximate five-second sensing stage during which the moisture sensor 113 senses the moisture content of the fabric and the intake air temperature sensor 108 and/or humidity sensor 112 detect the drying capability of the intake air. The controller, also using the indicated load size information, then selects the optimum sets of elapsed times and exhaust threshold temperatures (schedules) that will determine the initiations and durations of the stages. These schedules are selected from a predetermined table of schedules which, in the preferred embodiment, has up to five different schedules of elapsed times and temperatures. In general, larger load sizes and higher moisture content of the fabric tend to dictate greater heating in the form of longer elapsed times and higher threshold exhaust temperatures. Lower intake air temperatures and/or higher intake air humidity (indicating lower drying capability) likewise tend to dictate greater heating in the form of longer elapsed times and higher threshold temperatures. Sensing the moisture of the fabric also permits restarting an interrupted cycle safely.

In addition, the controller 100 will sense rotation of the chamber by means of the rotation sensor 106. If the chamber is not rotating the controller will emit a signal causing a fault light 166 to illuminate thereby notifying the operator to call for service. During this five-second sensing stage the controller 100 also applies control signals to the driver circuit 120 in preparation for energizing the magnetrons.

At the end of the five-second sensing stage the controller will start the first stage T-0 (T zero) by sending a control signal to the magnetron TRIACS 122 and the heater TRIAC 158. Upon receipt of the control signals at the TRIACS 122 the magnetrons 260 will be energized and emit microwave energy into the wave guides 272 which will conduct the energy into the rotating chamber 236. In addition, the control signal to TRIAC 158 will energize the augmentation heater 142 and heat the air that moves past it.

The recirculation damper solenoid 268 is activated by the controller 100 thereby opening the recirculation baffle permitting the exhaust air to be recirculated into the upper plenum 274 where it is mixed with the intake air and recirculated through the rotating chamber 236. In addition, the controller activates the exhaust damper solenoid 150 thereby closing the main exhaust damper 242 to prevent venting the exhaust air to the outside atmosphere and causing all exhaust air to be recirculated, further accelerating the temperature increase of the air. The intake air will obtain heat energy from: (1) the heat exchanger 323, (2) convection due to the warm components in the lower plenum 234, (3) the recirculated exhaust air, and (4) the augmentation heater 278 before entering the chamber.

The fabric drying system is now operating within the parameters of the initial stage of the drying cycle. During this stage the magnetrons 260 are energized, the augmentation heater 278 is energized, the recirculation baffle is open, and the main exhaust damper 242 is closed. This initial stage of the drying cycle serves to quickly bring the air up to a high temperature and to begin warming the moisture in the wet fabric.

The exhaust air temperature is used to provide an input signal to the controller which is proportionate to the exhaust air temperature. A comparator monitors the exhaust air temperature sensor and compares the signal to the predetermined exhaust threshold temperature values of the selected schedule. As the drying system operates the exhaust temperature will rise as the clothes become more dry. Accordingly, as the exhaust air temperature rises and reaches a threshold temperature the controller will trigger the end of one stage and initiate a subsequent stage. The exhaust air temperature is the primary means of triggering the end of one stage and the commencement of the subsequent stage; however, the elapsed time schedule can override the temperature when any stage has exceeded a predetermined time. Thus, in the description that follows reference will be made to the temperature which causes the end of a stage in a drying cycle but it should be remembered that if the temperature is not achieved, for whatever reason, the elapsed time schedule will trigger the end of the stage after a predetermined amount of time.

As already described, the first stage begins after the five-second sensing stage at which time the magnetrons and the augmentation heater are turned on and the recirculation baffle is open and the main exhaust damper is closed. This configuration quickly heats the air circulating in the system. When the exhaust air rises to the first threshold temperature T-1 the controller sends a control signal to TRIAC 158 turning off the augmentation heater. The system then continues operation with the magnetrons fully on as the only active source of heat. When the exhaust air rises to the second temperature threshold T-2 the CPU activates the solenoid 268 closing the recirculation baffle assembly 296 and also activates the exhaust damper solenoid 150 thereby opening the exhaust damper 242 and permitting the exhaust air to freely vent to the atmosphere.

When the exhaust air rises to the third threshold temperature T-3 the controller commences a timed pulsing sequence for controlling the magnetron power output. During pulsing the magnetrons will preferably operate on a one-second time base. Upon initiation of the pulsing sequence the magnetrons will be controlled through the TRIACS 122 so that they pulse at a variable rate which begins with a rate of ON for 0.9 seconds and OFF for 0.1 seconds. The pulsing initiations and durations for the respective rates are controlled by the variable elapsed time schedule preset within the controller. After a preset amount of time the controller will decrement the amount of ON-time for the magnetrons such that the magnetrons will be pulsed ON 0.8 seconds and OFF for 0.2 seconds. The pulsing sequence will continue whereby the ON-time is decremented in 0.1-second increments and the OFF-time will be incremented in 0.1-second increments. The magnetron filaments 260*a* are maintained at operating temperature during the entire timed pulsing sequence (even when power to the magnetrons is OFF) due to continuous inductance heating by the filament heaters 261 so that the pulsing rates are accurately representative of the actual time-averaged rates of energy generation. By keeping the filaments at operating temperature there is no heat-up transient during which the magnetrons cannot generate microwave energy. Thus, during the pulsing sequence the magnetrons are able to generate microwave energy during the entire ON period.

This pulsing method will prevent arcing of metallic objects that are associated with the fabric being dried.

As the moisture content of the fabric gets lower, i.e., the clothes get dryer, excess microwave power could cause a build-up of electrical charge on any metal components or electrical conductors associated with the fabric until the metal or electrical conductor is caused to discharge by arcing. The arcing is avoided by lowering the microwave power that the fabric is subjected to. In this way any build-up of electrical charge in the metallic components will discharge during the magnetron OFF cycle thereby preventing arcing. The magnetron power will continue to decrement under the aforementioned schedule. If, in spite of the lower microwave power, the exhaust air temperature increases to a temperature T-control then the controller will automatically decrement the power of the magnetrons further. Should the temperature continue to increase or remain above temperature T-control the controller will again decrement the power of the magnetrons.

When the exhaust temperature decreases to T-4 due to the decreasing power output of the magnetrons, the recirculation damper is opened to slow down the cooling of the air passing through the fabric chamber 236. The exhaust temperature will continue to drop due to the decreasing magnetron power output until it reaches a threshold temperature T-5 at which time the augmentation heater is turned on to supplement the decreasing power output of the magnetrons. The augmentation heater continues to finish the drying in conjunction with the heat exchanger and/or recirculated air while the magnetron power output decreases to the end of its sequence i.e., 0.1 second ON and 0.9 seconds OFF, at which time the controller will send a control signal to TRIACS 122 turning off the magnetrons. At this point the controller will establish a lock-out signal to prevent the magnetrons from coming on again throughout the remainder of the drying cycle regardless of the exhaust temperature. The controller's lock-out signal will energize relay coil 147 144. When coil 144 is deactivated, switches 138 and 140 open breaking the circuit to the magnetron transformers 132 thus conserving power.

The cool-down stage is typically initiated by reference to a time control but may also initiate upon the exhaust temperature decreasing to a threshold temperature T-6. When the cool-down stage begins, the augmentation heater is turned off and the recirculation damper is closed. The automatic cool-down stage is temperature controlled and the dryer continues to tumble the fabric until the exhaust temperature drops to reach a preset cutoff temperature threshold T-7 which is normally around 85° F. The cool-down stage generally takes approximately 8–12 minutes. As stated, the cool-down stage is terminated when the exhaust air temperature reaches the preset temperature threshold T-7 but alternatively, the cooldown stage could be terminated by time. When the cooldown cycle has terminated all systems are turned off and the operator may remove the fabric from the drying system.

Although it is preferable that both the schedule of elapsed times and the schedule of threshold exhaust temperatures be variable in response to load and intake air parameters as described above, variability of only one of these schedules would be satisfactory and is within the scope of the present invention. In fact, in a simplified version of the invention, only one of these two schedules could be used. Also, although a comparison of sensed exhaust air temperatures with a schedule of threshold temperatures is the preferred method of controlling the initiation and termination of the various operational stages of the system as described, a comparison of sensed exhaust air humidities with a schedule of threshold humidity values would accomplish many of the objectives of the invention and is likewise within the scope of the invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A fabric dryer comprising:

(a) a drying chamber for receiving fabric laden with moisture;

(b) an air intake duct for conducting air from the atmosphere into said drying chamber;

(c) an air exhaust duct for conducting said air and moisture from said drying chamber into the atmosphere;

(d) a source of microwave energy for generating heating energy at variable time-averaged rates to heat said moisture in said drying chamber;

(e) control means for selectively said source of microwave energy so as to generate heating energy in the form of microwave pulses of progressively decreasing pulse widths;

(f) said source of microwave energy comprising a magnetron having an electrical field-creating filament and means for heating said filament to maintain the temperature thereof substantially constant in the intervals between said pulses.

2. A fabric dryer comprising:

(a) a drying chamber for receiving fabric laden with moisture;

(b) an air intake duct for conducting air from the atmosphere into said drying chamber;

(c) an air exhaust duct for conducting said air and moisture from said drying chamber into the atmosphere;

(d) a source of microwave energy for generating heating energy at variable time-averaged rates to heat said moisture in said drying chamber; and (e) control means for selectively actuating said source of microwave energy so as to generate heating energy at progressively lower different time-averaged rates, said control means including means for setting respective predetermined times at which said source of microwave energy begins to generate heating energy at respective different time-averaged rates.

3. The apparatus of claim 2, including an intake air capability sensor for sensing the drying capability of air from the atmosphere which enters said air intake duct, said control means including means for varying said respective predetermined times in response to variations in the drying capability sensed by said intake air capability sensor.

4. The apparatus of claim 2 wherein said control means includes means for preventing said time-averaged rates from being increased to the highest of said rates after said rates have begun to be decreased.

5. A fabric dryer comprising:

(a) a drying chamber for receiving fabric laden with moisture;

(b) an air intake duct for conducting air from the atmosphere into said drying chamber;

(c) an air exhaust duct for conducting said air and moisture from said drying chamber into the atmosphere;

(d) a source of microwave energy for generating heating energy at variable time-averaged rates to heat said moisture in said drying chamber; and (e) control means for selectively actuating said source of microwave energy so as to generate heating energy at progressively lower different time-averaged rates, said control means including means for setting respective predetermined durations during which said source of microwave energy generates energy at respective different time-averaged rates.

6. The apparatus of claim 5, including an intake air capability sensor for sensing the drying capability of air from the atmosphere which enters said air intake duct, said control means including means for varying said respective predetermined durations in response to variations in the drying capability sensed by said intake air capability sensor.

7. The apparatus of claim 5 wherein said control means includes means for preventing said time-averaged rates from being increased to the highest of said rates after said rates have begun to be decreased.

8. A fabric dryer comprising:

(a) a drying chamber for receiving fabric laden with moisture;

(b) an air intake duct for conducting air from the atmosphere into said drying chamber;

(c) an air exhaust duct for conducting said air and moisture from said drying chamber into the atmosphere;

(d) a source of microwave energy for generating heating energy at variable time-averaged rates to heat said moisture in said drying chamber;

(e) control means for selectively actuating said source of microwave energy so as to generate heating energy at progressively lower different time-averaged rates;

(f) an intake aircapability sensor for sensing the drying capability of air from the atmosphere which enters said air intake duct; and (g) said control means including means for variably actuating said source of micro wave energy at said different time-averaged rates in response to variations in the drying capability sensed by said intake air capability sensor.

9. The apparatus of claim 8 wherein said control means includes means for preventing said time-averaged rates from being increased to the highest of said rates after said rates have begun to be decreased.

10. A fabric dryer comprising: drying chamber for receiving fabric (a) a drying chamber for receiving fabric laden with moisture;

(b) an air intake duct for conducting air from the atmosphere into said drying chamber;

(c) an air exhaust duct for conducting said air and moisture from said drying chamber into the atmosphere;

(d) a source of microwave energy for generating heating energy at variable time-averaged rates to heat said moisture in said drying chamber;

(e) an exhaust temperature sensor for sensing variations in the temperature of said air after said air has been introduced into said drying chamber;

(f) control means for selectively actuating said source of microwave energy so as to generate heating energy at progressively lower different time-averaged rates in response to the temperature sensed by said exhaust temperature sensor rising to a predetermined magnitude.

11. The apparatus of claim 10 wherein said control means includes means for preventing said time-averaged rates from being increased to the highest of said rates after said rates have begun to be decreased, irrespective of any decrease in said temperature.

12. A fabric dryer comprising:

(a) a drying chamber for receiving fabric laden with moisture;

(b) an air intake duct for conducting air from the atmosphere into said drying chamber;

(c) an air exhaust duct for conducting said air and moisture from said drying chamber into the atmosphere;

(d) a source of microwave energy for generating heating energy at variable time-averaged rates to heat said moisture in said drying chamber;

(e) a powered auxiliary source of heat separate from said source of microwave energy for heating said moisture in said drying chamber; and (f) control means for controlling said auxiliary source of heat variably in response to changes in said time-averaged rates.

13. The apparatus of claim 12 wherein said control means includes means for actuating said auxiliary source of heat in response to a decrease in said time-averaged rates.

14. A fabric dryer comprising:

(a) a drying chamber for receiving fabric laden with moisture;

(b) an air intake duct for conducting air from the atmosphere into said drying chamber;

(c) an air exhaust duct for conducting said air and moisture from said drying chamber into the atmosphere;

(d) a source of microwave energy for heating said moisture in said drying chamber;

(e) a powered auxiliary source of heat separate from said source of microwave energy for heating said moisture in said drying chamber;

(f) an exhaust condition sensor for sensing variations in the condition of said air after said air has been introduced into said drying chamber; and (g) control means for selectively actuating said source of microwave energy without actuating said auxiliary source of heat to heat said moisture in said drying chamber or, alternatively, actuating said source of microwave energy simultaneously with said auxiliary source of heat, in response to said condition sensed by said exhaust condition sensor.

15. The apparatus of claim 14 wherein said exhaust condition sensor includes means for sensing the temperature of said air after it has been introduced into said drying chamber.

16. A fabric dryer comprising:

(a) a drying chamber for receiving fabric laden with moisture;

(b) an air intake duct for conducting air from the atmosphere into said drying chamber;

(c) an air exhaust duct for conducting said air and moisture from said drying chamber into the atmosphere;

(d) means for recirculating air from said air exhaust duct into said drying chamber;

(e) recirculation damper means for variably regulating the flow of air recirculated from said air exhaust duct into said drying chamber;

(f) a powered source of heat for generating heating energy at variable time-averaged rates to heat said moisture in said drying chamber; and (g) control means for controlling said recirculation damper means variably in response to changes in said time-averaged rates.

17. The apparatus of claim 16 wherein said control means includes means for opening said recirculation damper means in response to a decrease in said time-averaged rates.

18. The apparatus of claim 17 wherein said powered source of heat comprises a source of microwave

19. The apparatus of claim 18, further including a powered auxiliary source of heat for heating said moisture in said drying chamber, wherein said control means further includes means for actuating said auxiliary source of heat in response to a further decrease in said time-averaged rates after said recirculation damper means has been opened.

* * * * *

UNITED STATES PATENT AND TRADEMARK OFFICE

CERTIFICATE OF CORRECTION

PATENT NO. : 5,321,897

DATED : June 21, 1994

INVENTOR(S) : Melvin Holst et al.

It is certified that error appears in the above-identified patent and that said Letters Patent is hereby corrected as shown below:

| | |
|---|---|
| Col. 1, line 40 | Delete the comma between "because" and "the" |
| Col. 1, line 50 | After "microwave" insert --energy source-- |
| Col. 1, line 54 | After "exhaust" insert --air humidity-- |
| Col. 4, line 25 | Delete the comma after "plenum" |
| Col. 6, line 40 | Delete the comma after "towards" |
| Col. 11, line 2 | After "136" insert --respectively-- |
| Col. 13, line 38 | After "147" insert --and open lock-out switch 143 deactivating main power coil-- |
| Col. 14, line 27 | After "selectively" insert --actuating-- |
| Col. 15, line 44 | Change "aircapacity" and to --air capacity-- |
| Col. 15, line 57/58 | Delete "drying chamber for receiving fabric" |

UNITED STATES PATENT AND TRADEMARK OFFICE

CERTIFICATE OF CORRECTION

PATENT NO. : 5,321,897

DATED : June 21, 1994

INVENTOR(S) : Melvin Holst, et al.

It is certified that error appears in the above-indentified patent and that said Letters Patent is hereby corrected as shown below:

Col. 18, line 6 After "microwave" insert --energy--.

Signed and Sealed this

Twentieth Day of September, 1994

*Attest:*

Bruce Lehman

BRUCE LEHMAN

*Attesting Officer*

*Commissioner of Patents and Trademarks*